US009445667B2

(12) United States Patent
McCuistion

(10) Patent No.: US 9,445,667 B2
(45) Date of Patent: Sep. 20, 2016

(54) ADJUSTABLE SHELVING SYSTEM

(71) Applicant: Michael T. McCuistion, Columbia, MO (US)

(72) Inventor: Michael T. McCuistion, Columbia, MO (US)

(73) Assignee: SWINGSTOW, LLC, Columbia, MO (US)

( * ) Notice: Subject to any disclaimer, the term of this patent is extended or adjusted under 35 U.S.C. 154(b) by 0 days.

(21) Appl. No.: 14/604,080

(22) Filed: Jan. 23, 2015

(65) Prior Publication Data

US 2016/0198845 A1 Jul. 14, 2016

Related U.S. Application Data

(63) Continuation-in-part of application No. 14/592,065, filed on Jan. 8, 2015.

(51) Int. Cl.
*A47B 53/02* (2006.01)
*A47B 49/00* (2006.01)

(52) U.S. Cl.
CPC ..... *A47B 53/02* (2013.01); *A47B 49/004* (2013.01)

(58) Field of Classification Search
CPC .... A47B 53/02; A47B 49/004; A47B 43/00; E05D 3/022; B60B 33/0002; Y10T 16/5327; Y10T 16/5361; Y10T 16/539
USPC ..... 211/150, 86.01
See application file for complete search history.

(56) References Cited

U.S. PATENT DOCUMENTS

| | | | | | |
|---|---|---|---|---|---|
| 241,123 | A * | 5/1881 | Danner | A47B 49/004 312/199 |
| 1,241,615 | A * | 10/1917 | Farrow | E05G 1/00 109/23 |
| 2,373,955 | A * | 4/1945 | Fuller | E05D 7/0423 126/194 |
| 3,070,416 | A * | 12/1962 | Post | A47B 17/00 108/14 |
| 4,848,585 | A * | 7/1989 | Snyder | A45C 11/16 206/315.11 |
| D372,607 | S * | 8/1996 | Pallas | D6/671.1 |
| D629,228 | S * | 12/2010 | Allman | D6/680 |
| 2002/0180318 | A1 * | 12/2002 | Bitner | B25H 3/023 312/200 |

* cited by examiner

*Primary Examiner* — Korie H Chan
(74) *Attorney, Agent, or Firm* — Dale J Ream

(57) ABSTRACT

An adjustable shelving system includes a base member having opposed first and second sides. A plurality of first shelf assemblies are coupled to the first side of the base member, each first shelf assembly being movable between a first rearward configuration perpendicular to the base member and a first forward configuration forwardly offset relative to the rearward configuration. A second plurality of shelf assemblies are pivotally coupled to the second side of the base member, each second shelf assembly being movable between a second rearward configuration perpendicular to the base member and a second forward configuration forwardly offset relative to the rearward configuration. Each shelf assembly includes rollers configured to support the weight of the shelf assembly and enhance movement. Each shelf assembly may include a vertically floatable hinge configured to allow the shelf assembly to move up or down according to changes in elevation of a floor surface.

15 Claims, 9 Drawing Sheets

ADJUSTABLE SHELVING SYSTEM

REFERENCE TO RELATED APPLICATION

This application claims priority to and is a continuation-in-part of U.S. patent application Ser. No. 14/592,065 filed on Jan. 8, 2015 and titled Vertically Floating Hinge and incorporates said application by reference.

BACKGROUND OF THE INVENTION

This invention relates generally to a shelving system and, more particularly, to an adjustable shelving system having a plurality of rolling shelf assemblies pivotally coupled to a fixed base member that are movable to desired configurations.

Multiple unit shelving systems, such as may be found in libraries, bookstores, commercial facilities, and even in garages or residential areas are very desirable for holding a high volume of articles such as books, tubs filled with hardware, toys, memorabilia, and much more. Unfortunately, multiple shelving units take up a great deal of space as they must be lined up side by side or spaced apart in parallel alignment such that the front of each unit is accessible. Further, the back of such units are typically not configured to themselves be functional to hold or display items.

Various devices are known in the art that are movable so that they may be stored out of the way until needed. Although assumably effective for their intended use, movable shelf units may be unstable and risk prone to being tipped over which can cause injury to users or damage to goods.

Therefore, it would be desirable to have an adjustable shelving system having multiple shelf assemblies that are pivotally coupled to a base member and movable between forward and rearward configurations so as to be compact when access is not needed and expanded when access is desired. Further, it would be desirable to have an adjustable shelving system in which the shelf assemblies are supported upon rollers that enhance smooth and safe movement of the assemblies. In addition, it would be desirable to have an adjustable shelving system in which shelf assemblies are mounted with vertically flexible hinges that enable a shelf assembly to move up or down with elevation changes in a floor surface such that corresponding rollers maintain contact with the floor to support the weight of the shelf assembly.

SUMMARY OF THE INVENTION

An adjustable shelving system according to the present invention includes a base member having opposed first and second sides. A plurality of first shelf assemblies are coupled to the first side of the base member, each first shelf assembly being movable between a first rearward configuration generally perpendicular to the base member and a first forward configuration forwardly offset relative to the rearward configuration. A second plurality of shelf assemblies are pivotally coupled to the second side of the base member, each second shelf assembly being movable between a second rearward configuration generally perpendicular to the base member and a second forward configuration forwardly offset relative to the rearward configuration.

Each shelf assembly is spaced apart from each other shelf assembly and is independently pivotally coupled to the base member. Each shelf assembly includes shelves accessible from a front side and suitable for supporting articles. Each shelf assembly includes a peg board accessible from a back side and suitable for hanging tools and the like. Each shelf assembly includes one or more rollers or wheels configured to support the weight of the shelf assembly and enhance movement between rearward and forward positions. Each shelf assembly may be coupled to the base member with a vertically floatable hinge configured to allow a respective shelf assembly to move up or down according to changes in elevation of a floor surface.

Therefore, a general object of this invention is to provide an adjustable shelving system having multiple shelf assemblies pivotally movable about a base member between forward and rearward configurations.

Another object of this invention is to provide an adjustable shelving system, as aforesaid, in which the multiple shelf assemblies are quickly and easily movable between compact storage configurations and expanded access configurations.

Still another object of this invention is to provide an adjustable shelving system, as aforesaid, in which each shelf assembly includes rollers that enhance smooth movement and partially support the weight of the assembly.

Yet another object of this invention is to provide an adjustable shelving system, as aforesaid, in which shelf assemblies are coupled to the base member with vertically adjustable floating hinges that enable the shelf unit to shift upwardly or downwardly according to elevation changes in a floor surface.

A further object of this invention is to provide an adjustable shelving system, as aforesaid, in which the back of each shelf assembly includes a pegboard covering that is configured to hang items such as tools.

A still further object of this invention is to provide an adjustable shelving system, as aforesaid, in which the base member is fixed and stable such that rolling movement, even of heavily laden assemblies, is stable and safe.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
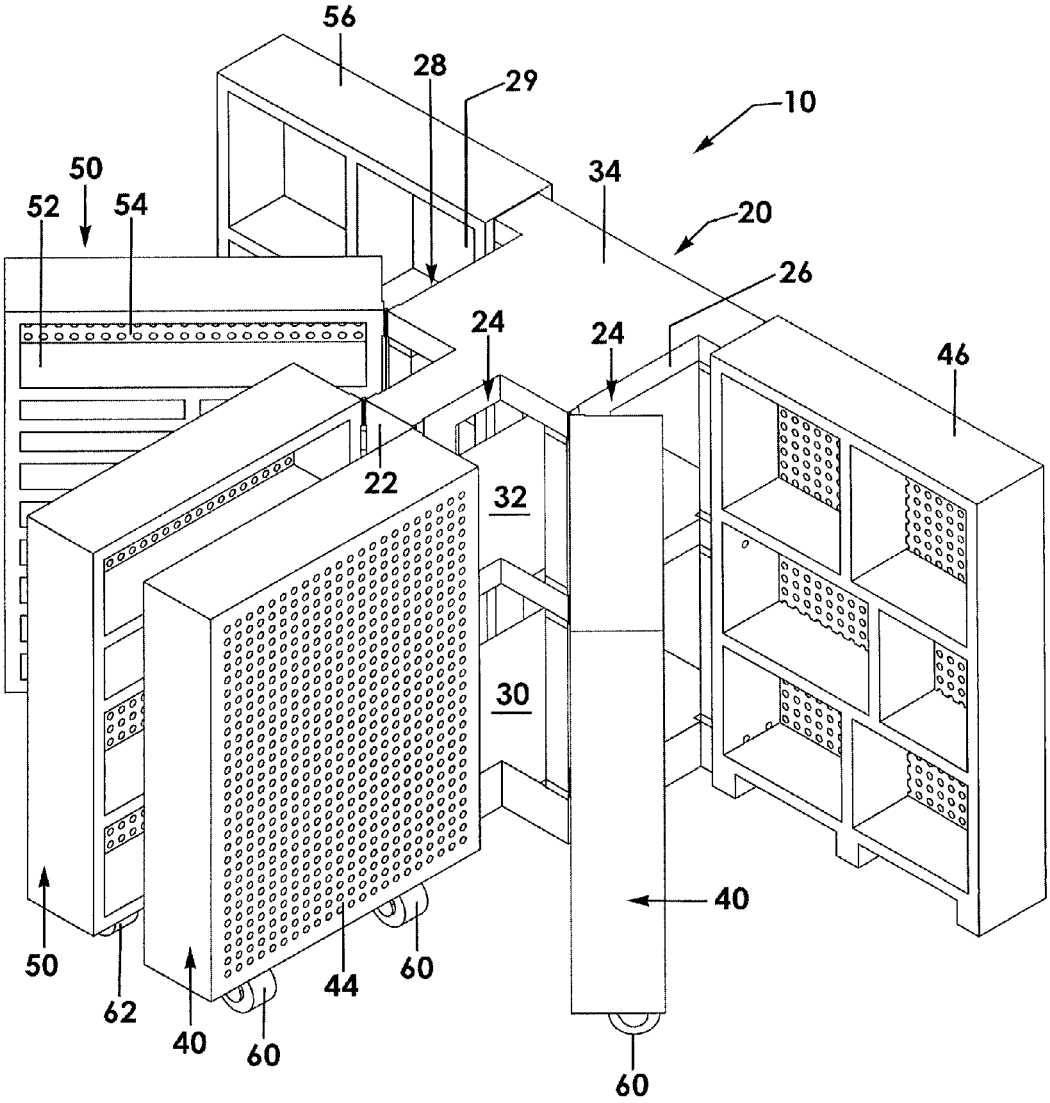
FIG. 1 is a perspective view of an adjustable shelving system according to a preferred embodiment of the present invention illustrated with selected shelf assemblies in forward configurations.

An adjustable shelving system according to a preferred embodiment of the present invention will now be described in detail with reference to FIGS. 1 to 7*b* of the accompanying drawings. The shelving system 10 includes a base member 20 (also referred to as a base shelving unit), a plurality of first shelf assemblies 40 pivotally coupled to a first side 24 of the base member 20, and a plurality of second shelf assemblies 50 pivotally coupled to a second side 28 of the base member 20. One or more rollers may be coupled to a bottom surface of each shelf assembly to facilitate movement thereof. Each shelf assembly may be pivotally coupled to the base member 20 with a floating hinge 70 that enables a respective shelf assembly to float upward or downward as it moves on an uneven floor surface or over a small obstacle.

The base member 20 is a shelving unit having a base portion, intermediate portion, and top portion (FIG. 1). The base member 20 includes a front side, back side, first side 24, and a second side 28 opposed from the first side 24. Each side is open and can be accessed such as to place or remove stored items. The base portion has a planar top surface that may be referred to as a bottom shelf 30. Similarly, the intermediate portion has a planar surface that is upwardly displaced from and parallel to the bottom shelf 30 that may be referred to as an intermediate shelf 32. The top portion also includes a planar upper surface that is upwardly displaced from and parallel to the intermediate shelf 32 that may be referred to as a top shelf 34.

The first side 24 of the base member 20 includes a plurality of graduated first sections 26. Similarly, the second side 28 of the base member 20 includes a plurality of graduated second sections 29. As shown in the drawings, the plurality of corresponding graduated sections is like corresponding stair steps getting narrower toward the front end 22. More particularly, a corresponding pair of first and second sections 26, 29 defines a width that is greater than a width of a forwardly adjacent corresponding pair of first and second sections, 26*a*, 29*a*.

The plurality of first shelf assemblies 40 is pivotally coupled to the first side 24 of the base member 20. More specifically, respective first shelf assemblies 40 are pivotally coupled to respective graduated first sections 26 of the base member 20. In other words, a first shelf assembly 40 is coupled to a respective graduated first section 26. Each first shelf assembly 40 may be pivotally coupled to a respective graduated first section 26 with a hinge 70 as will be further described later. The pivotal connection of the first shelf assembly 40 to a respective section of the first side 24 of the base member 20 defines an imaginary vertical longitudinal axis about which the first shelf assembly 40 is selectively rotated between the first rearward configuration and a first forward configuration.

Preferably, each first shelf assembly 40 is spaced apart from and independently movable relative to each other first shelf assembly 40. Each first shelf assembly 40 is pivotally movable on respective hinges between a first rearward configuration (FIG. 2) generally perpendicular to the respective first side section of the base member 20 and a first forward configuration (FIG. 1) forwardly offset from the first rearward configuration. A first shelf assembly 40 may be pivotally moved all the way to a forward configuration generally parallel to a respective first side section (see forward-most first shelf assembly FIG. 1).

Similarly, the plurality of second shelf assemblies 50 is pivotally coupled to the second side 28 of the base member 20. More specifically, respective second shelf assemblies 50 are pivotally coupled to respective graduated second sections 29 of the base member 20. In fact, a second shelf assembly 50 is coupled to a respective graduated second section 29. Each second shelf assembly 50 may be pivotally coupled to a respective graduated second section 29 with a hinge 70 as will be further described later. The pivotal connection of the second shelf assembly 50 to a respective section of the second side 28 of the base member 20 defines an imaginary vertical longitudinal axis about which the second shelf assembly 50 is selectively rotated between the second rearward configuration and the second forward configuration.

Preferably, each second shelf assembly 50 is spaced apart from and independently movable relative to each other second shelf assembly 50. Each second shelf assembly 50 is pivotally movable on respective hinges between a second rearward configuration (FIG. 2) generally perpendicular to the respective second side section of the base member 20 and a second forward configuration (FIG. 1) forwardly offset from to the second rearward configuration. A second shelf assembly 50 may be pivotally moved all the way to a forward configuration generally parallel to a respective second side section 29 (see forward-most second shelf assembly FIG. 1).

Each first shelf assembly (from the plurality of first shelf assemblies or from the plurality of second shelf assemblies) includes a plurality of vertically spaced apart shelves 42, 52 configured to support articles thereon, for example, in the nature of book shelves. It is understood that each shelf assembly may have a different configuration of shelves than any other shelf assembly although some assemblies may be the same. The shelves are accessible through the open front of respective shelf assemblies. In addition, each shelf assembly may include a sheet of peg board 44, 54 covering a back portion of a respective shelf assembly (FIG. 1). A sheet of peg board may include a plurality of holes configured to receive hook hardware suitable for holding tools or the like.

In an embodiment, the shelving system 10 may include a pair of fixed position shelf assemblies, i.e. that are not pivotal but rather lend stability to the system. More particularly, a first rear shelf assembly 46 is fixedly coupled to the first side 24 of the base member 20 (FIG. 1). Similarly, a second rear shelf assembly 56 is fixedly coupled to the second side 28 of the base member 20. Each rear shelf assembly is generally perpendicular to a respective side (or side section) of the base member 20 and extends outwardly therefrom. In one embodiment, the rear assemblies may have feet, legs, or a flat bottom surface in contact with a floor surface. In another embodiment, the rear assemblies may be mounted to a wall of a room, such as a basement wall or a garage wall of a residence or the like.

Figure 2:
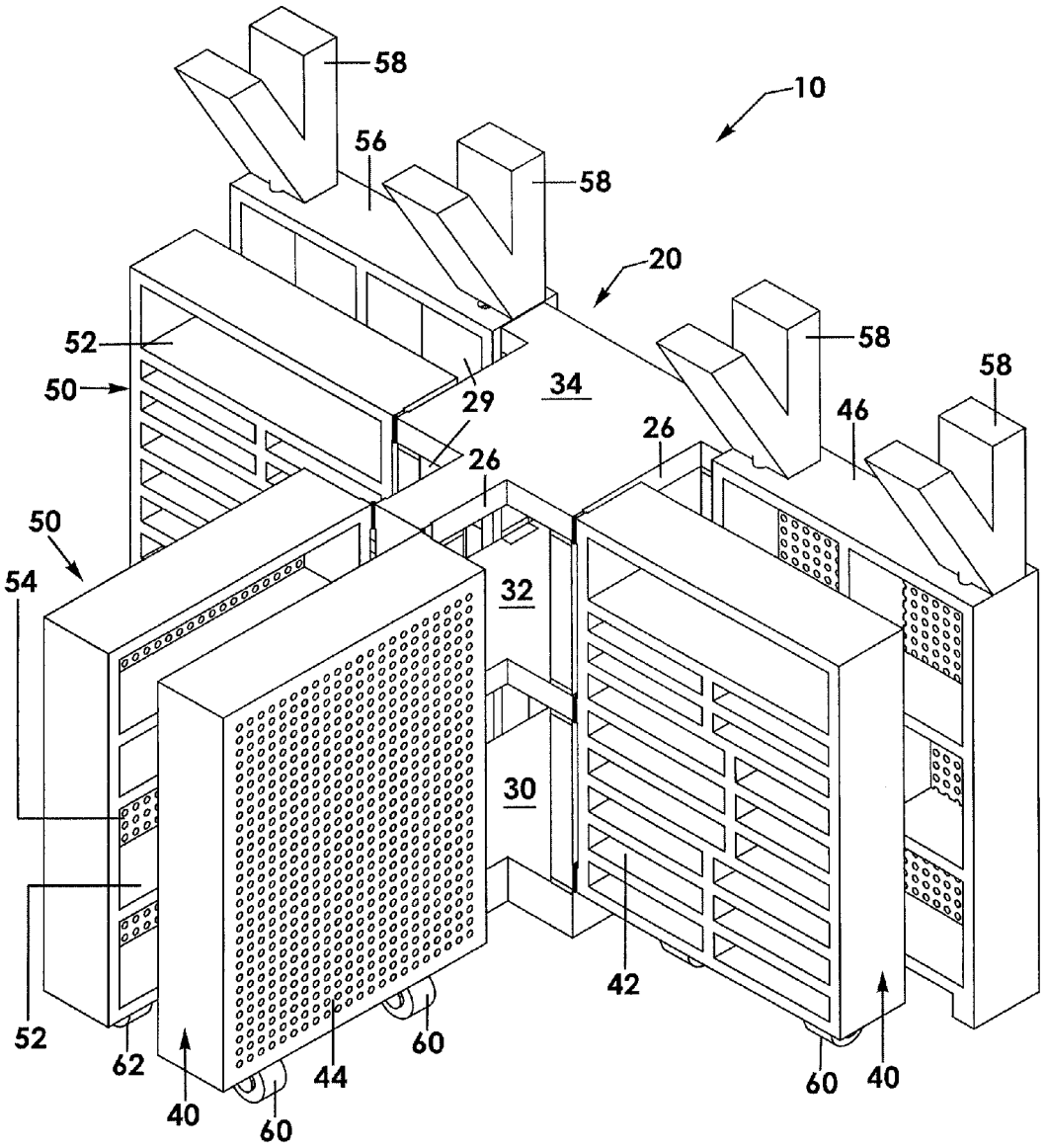
FIG. 2 is another perspective view of the shelving system as in FIG. 1 with selected shelf assemblies in fully forward configurations and others in fully rearward configurations.
Figure 3:
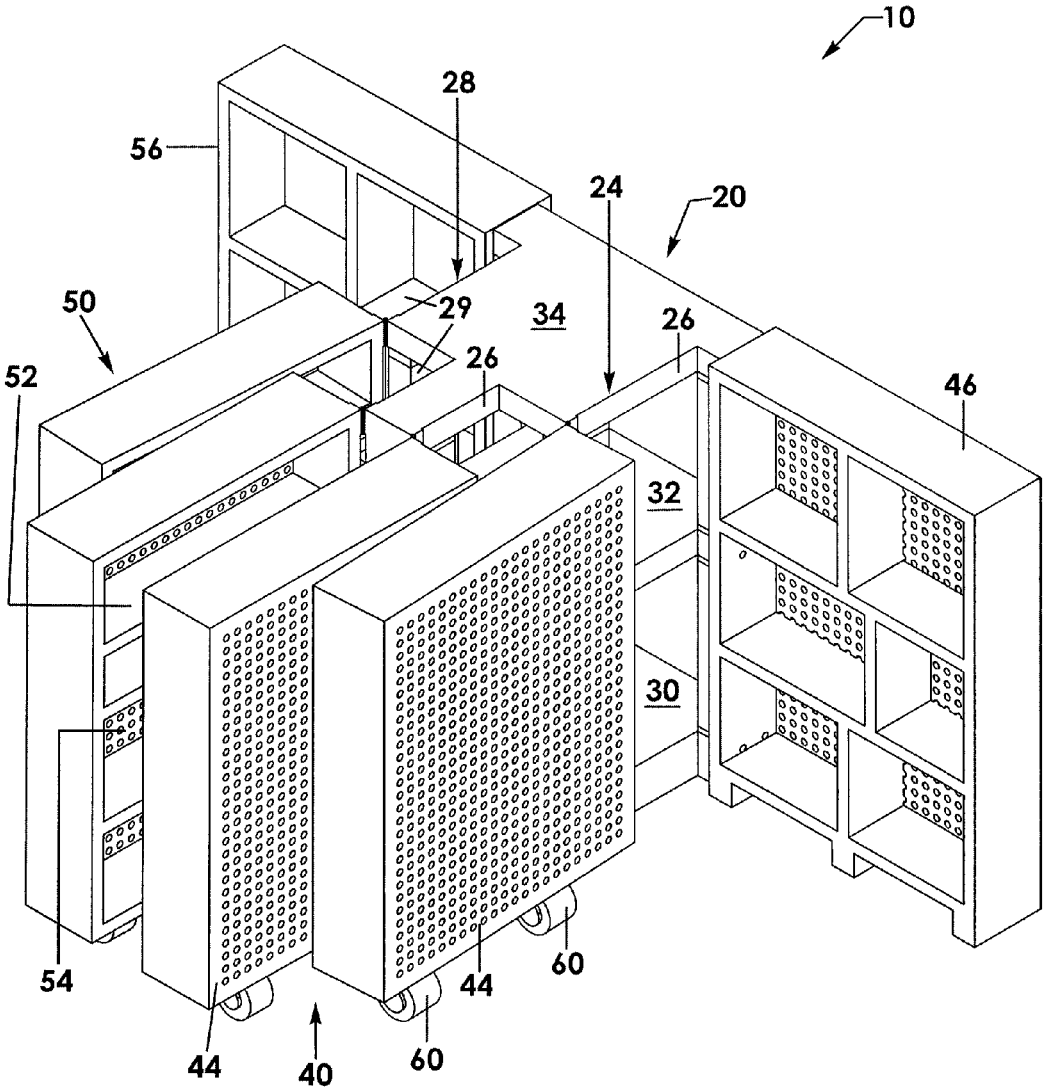
FIG. 3 is another perspective view of the shelving system as in FIG. 1 with all pivotal shelving assemblies in fully forward configurations.
Figure 4:
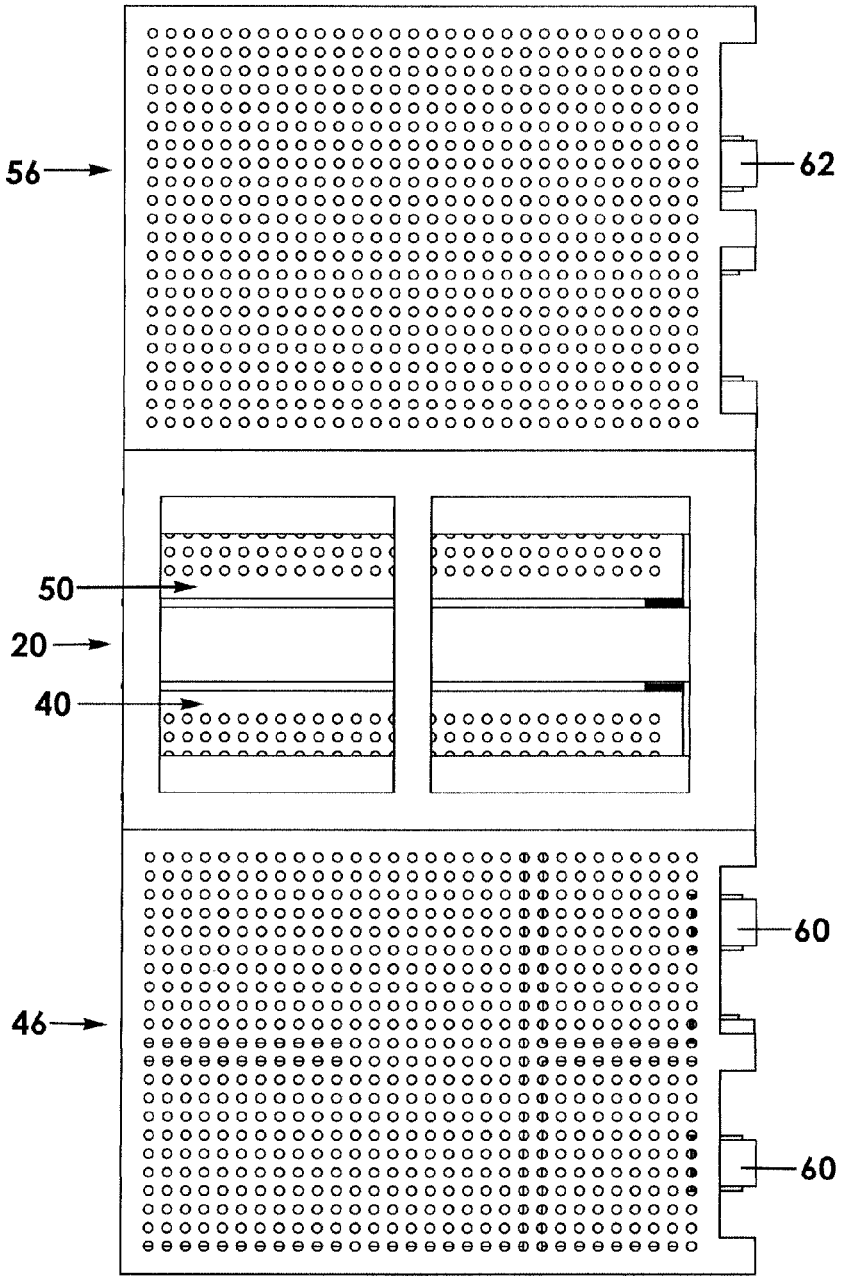
FIG. 4 is a rear view of the shelving system as in FIG. 1.
Figure 5A:
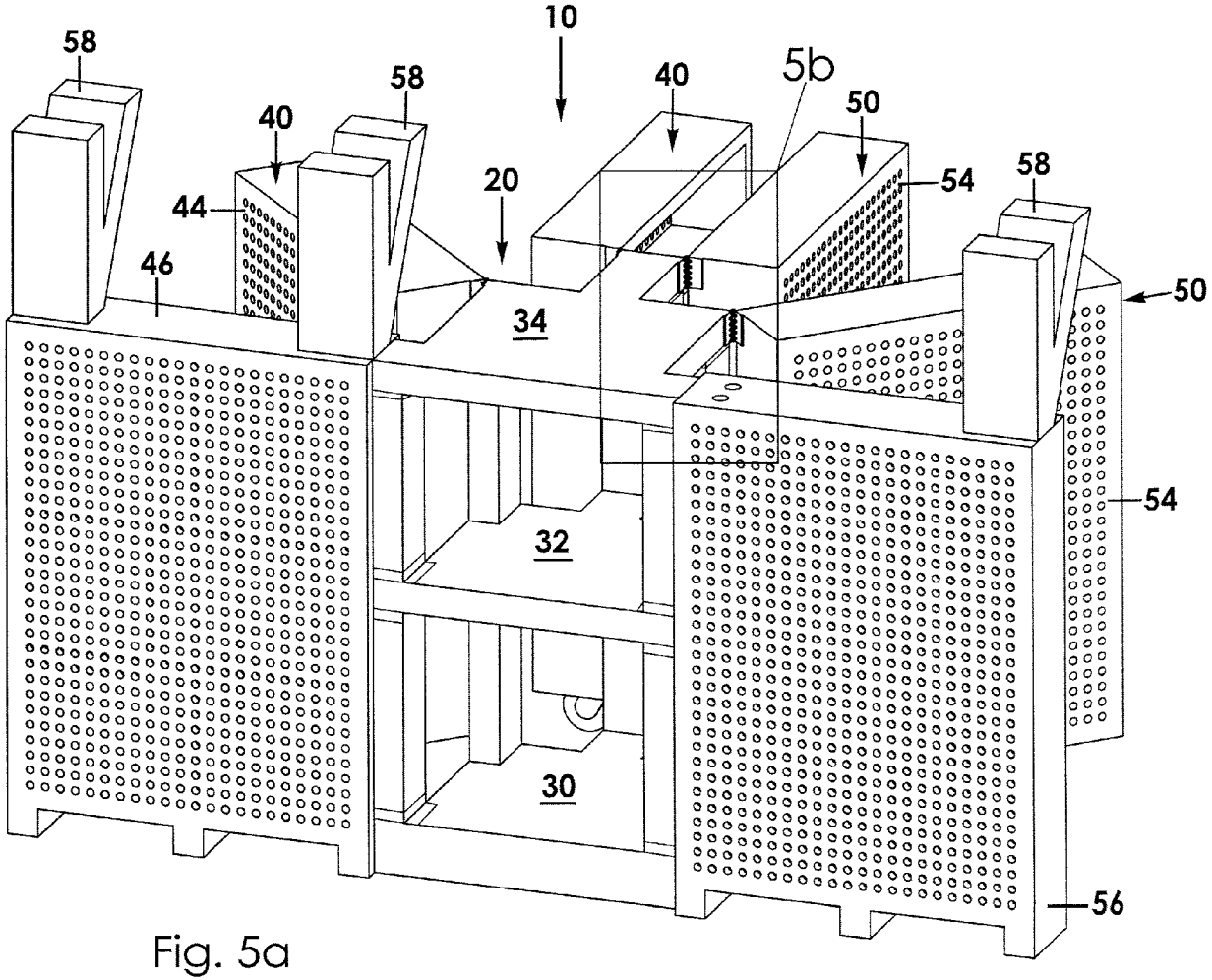
FIG. 5*a* is a perspective rear view of the shelving system as in FIG. 2.
Figure 5B:
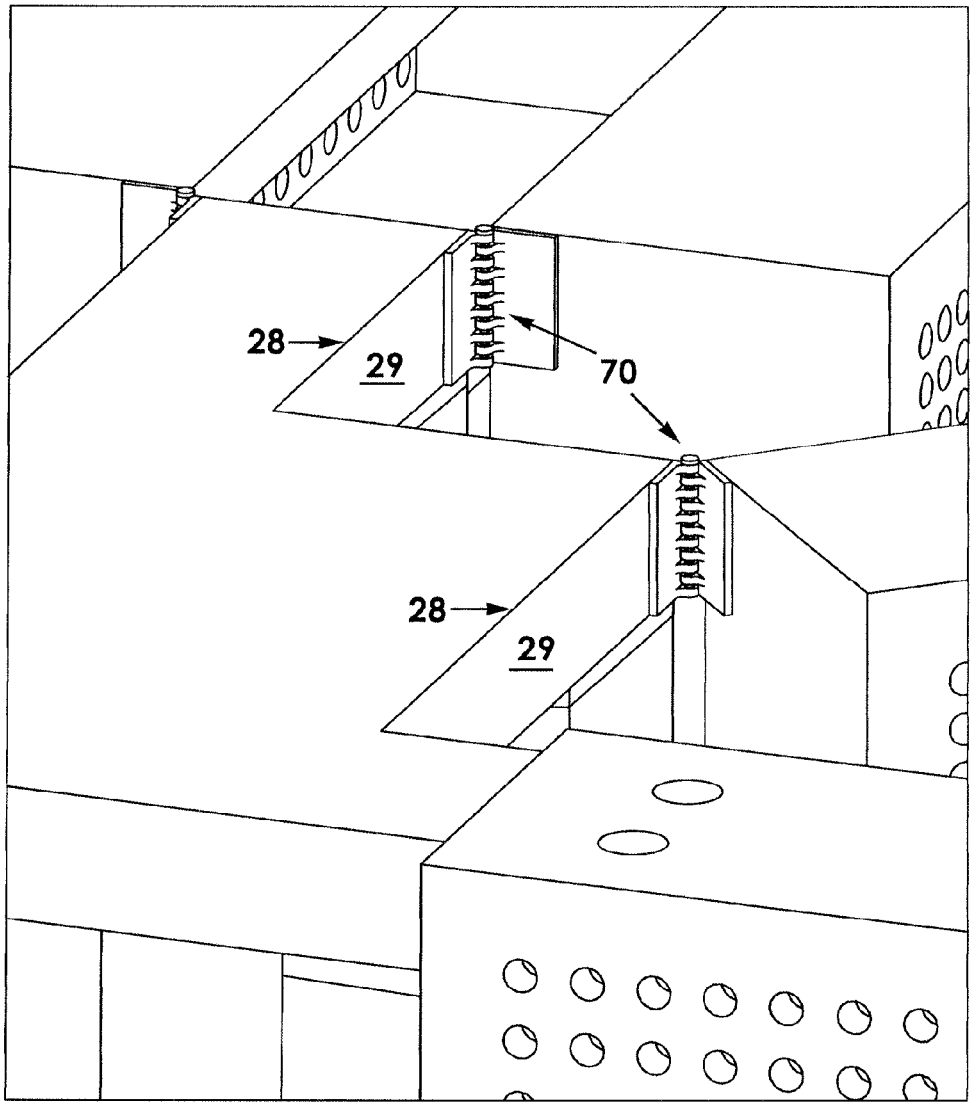
FIG. 5*b* is an isolated view on an enlarged scale taken from a portion of FIG. 5*a;*

In another embodiment, a plurality of ceiling support members 58 is coupled to a top surface of each first rear shelf assembly and to each second rear shelf assembly. The ceiling support members 58 are spaced apart along the top surfaces and extend upwardly (FIG. 2). It is understood that the ceiling support members 58 may be coupled to rafters, a ceiling, or other support structure so as to enhance the stability of the shelving system 10.

Figure 6A:
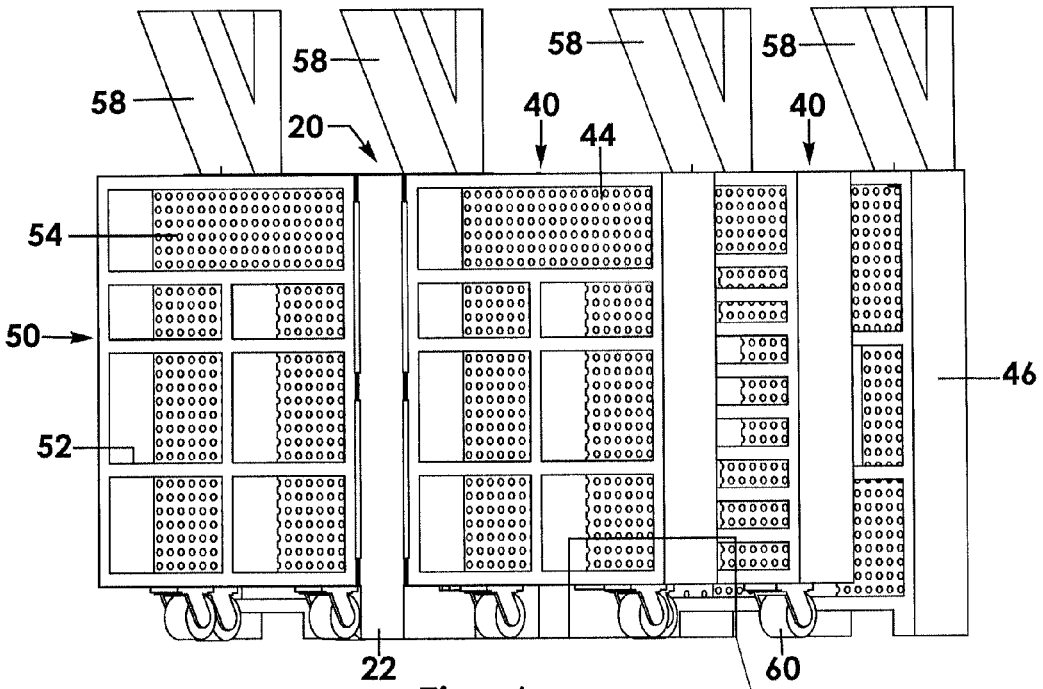
FIG. 6*a* is a front view of the shelving system according to the present invention.
Figure 6B:
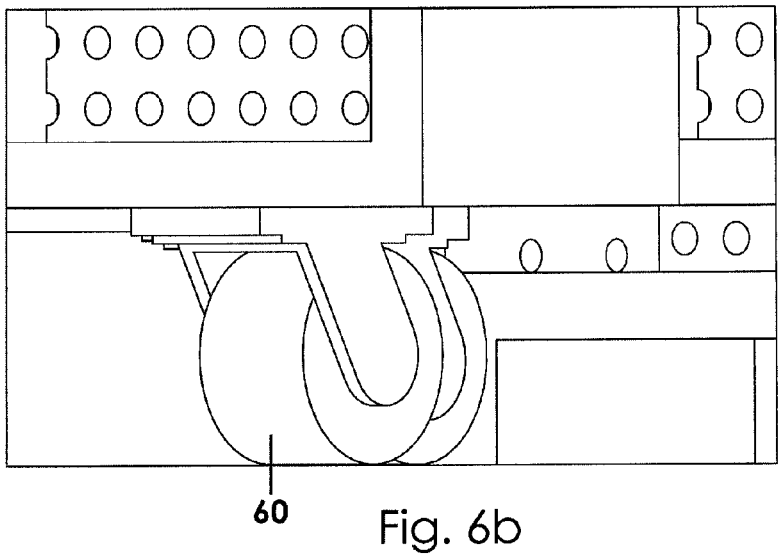
FIG. 6*b* is an isolated view on an enlarged scale taken from a portion of FIG. 6*b;*

In another aspect, each of the plurality of shelf assemblies includes rollers or wheels to enhance and support the pivotal movement thereof described previously. More particularly, at least one first roller 60 is coupled to an underside of each first shelf assembly 40 (FIGS. 6*a* and 6*b*). Each first roller 60 is robust and configured to support a respective first shelf assembly 40 on a floor surface and to provide smooth movement between said first rearward configuration and the first forward configuration. The first rollers 60 are relied upon to support some of the weight of respective first shelf assemblies 40 when floating hinges are used to couple respective first shelf assemblies 40 to the base member 20 as will be described later. Similarly, at least one second roller 62 is coupled to an underside of each second shelf assembly 50 (FIGS. 6*a* and 6*b*). The function of each second roller 62 is the same as that of each first roller 60 and need not be explained in detail.

As disclosed earlier, each shelf assembly (first or second) may be pivotally coupled to a respective side of the base member 20 with a hinge 70. Preferably, the hinge 70 used in the preferred embodiment is a vertically floating hinge shown particularly in FIGS. 7*a* to 8*b*. References to the hinge 70 and the "floating hinge" will hereafter be made using the same reference numeral 70. The floating hinge 70 is configured to enable an attached shelf assembly to move upward if a corresponding roller rolls onto a raised surface or, conversely, to enable an attached shelf assembly to move downward if a corresponding roller rolls into a recessed surface. This configuration alleviates the strain on the hinges so as to reduce failures or damage thereto.

Figure 8A:
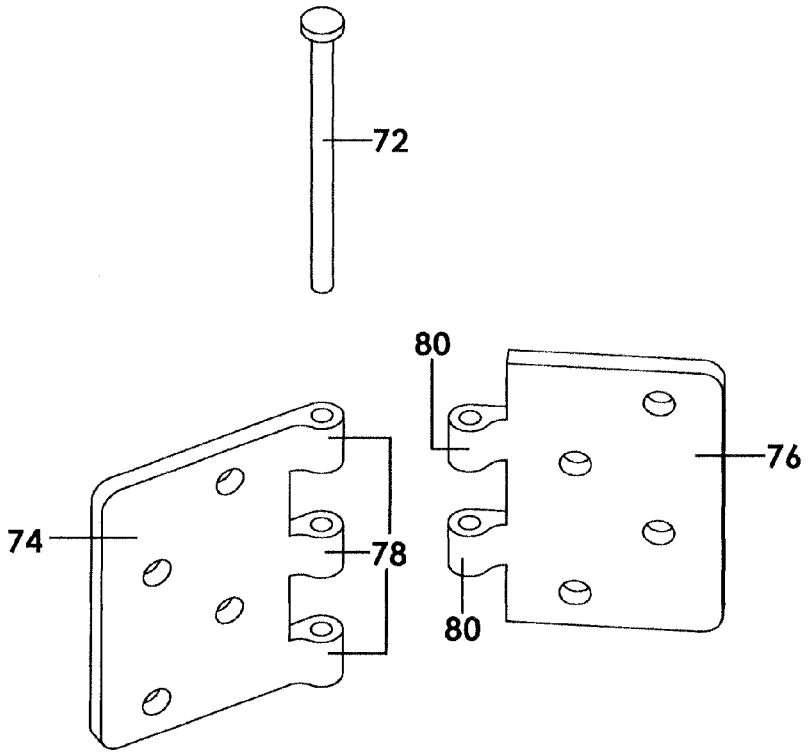
FIG. 8*a* is an exploded view of the floating hinge as in FIG. 7*a*.

The floating hinge 70 includes a pin 72 having an elongate and linear configuration as is common to hinges (FIG. 8*a*). The floating hinge 70 also includes a first leaf 74 having at least a pair of space apart "first-leaf knuckles" 78 rotatably coupled to the pin 72 and configured so that the first leaf 74 is selectively rotatable about the pin 72. It is understood that this movement is how a respective shelf assembly is rotatable relative to the base member 20. By way of example, the first leaf 74 would be attached to a respective side of the base member. The floating hinge 70 includes a second leaf 76 having at least one second-leaf knuckle 80 rotatably coupled to the pin 72 and situated between the pair of spaced apart first-leaf knuckles 78.

Figure 7A:
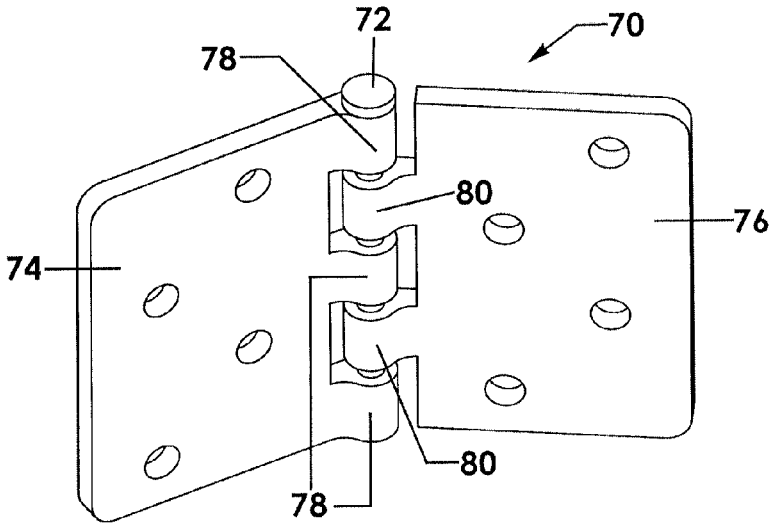
FIG. 7*a* is a perspective view of a floating hinge illustrated in a neutral configuration.
Figure 7B:
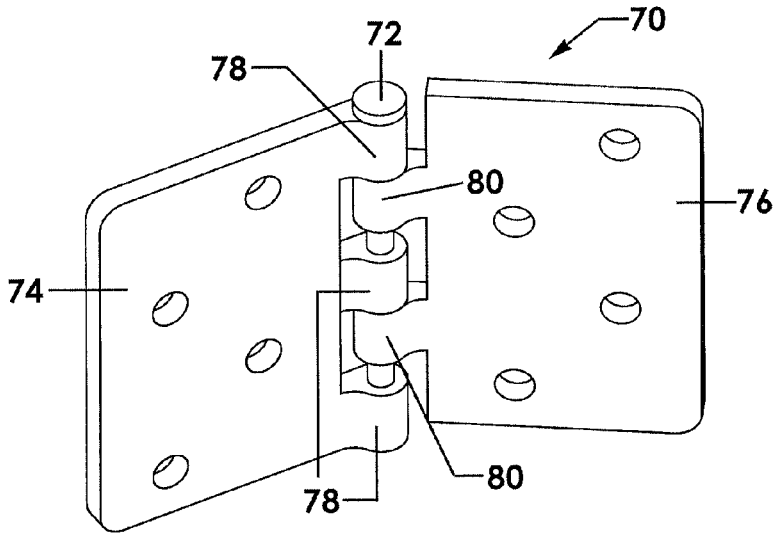
FIG. 7*b* is a perspective view of the floating hinge as in FIG. 7*a* illustrated in a raised configuration.
Figure 8B:
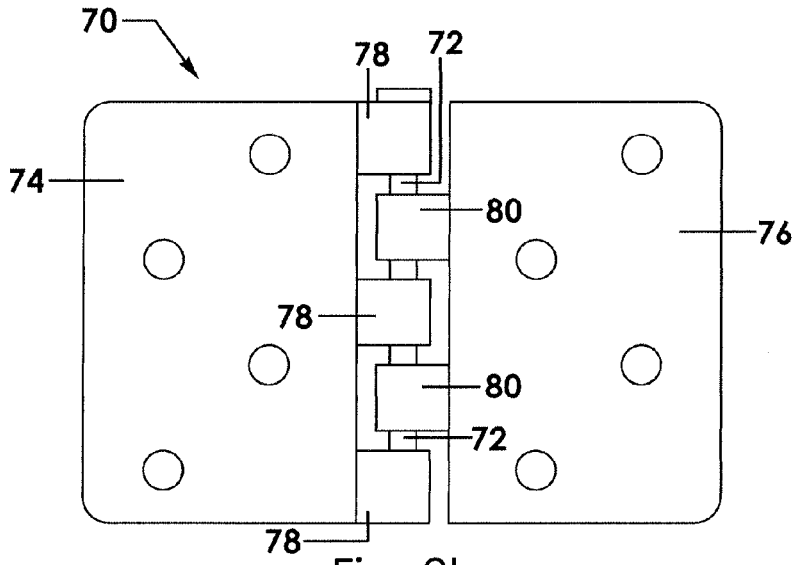
FIG. 8*b* is a front view of the floating hinge as in FIG. 7*a*.

The second-leaf knuckle 80 is configured to slide along the pin 72 between the pair of spaced apart first-leaf knuckles 78. Even more particularly, the second-leaf knuckle 80 is configured to slide up and down along the pin 72 between the pair of spaced apart first-leaf knuckles 78. To accomplish this configuration, the second-leaf knuckle 80 is smaller than the space between the pair of first-leaf knuckles 78. FIGS. 7*b* and 8*b* may be compared to understand how the first leaf 74 and second leaf 76 are adjusted vertically relative to one another.

In use, the first leaf 74 would be fixedly attached to the first side 24 of the base member 20 while the second leaf 76 would be fixedly attached to a respective first shelf assembly 40. When the first shelf assembly 40 is swinging/pivoting as described above and the corresponding first roller 60 rolls upon an obstacle or the floor surface inclines, the second leaf 76 is urged upwardly along the hinge pin 72 and the entire respective first shelf assembly 40 is moved upwardly. When the first roller 60 rolls down from the obstacle or the floor surface levels out, the second leaf 76 is naturally urged downwardly along the hinge pin 72. It can be seen that the floating hinge 70 relieves the strain that would be put on a traditional hinge 70 experienced by rotating without the support of a roller and without the ability to adjust vertically as a result of obstacles or uneven surfaces.

As shown in the drawings, respective shelf assemblies may be selectively pivoted between rearward configurations at which articles may be accessed on respective shelves and forward configurations at which tools or other articles may be stored or accessed on respective peg boards. The configuration of multiple shelf assemblies pivotally coupled to the base member 20 maximizes the amount of storage and minimizes the amount of floor space required to accomplish the storage benefits.

It is understood that while certain forms of this invention have been illustrated and described, it is not limited thereto except insofar as such limitations are included in the following claims and allowable functional equivalents thereof.

The invention claimed is:

1. An adjustable shelving system, comprising:

an upstanding base member having a first side and a second side opposite said first side;

a plurality of first shelf assemblies pivotally coupled to said first side of said base member, each first shelf assembly being movable between a first rearward configuration generally perpendicular to said base member and a first forward configuration forwardly offset relative to said rearward configuration;

a plurality of second shelf assemblies pivotally coupled to said second side of said base member, each second shelf assembly being movable between a second rearward configuration generally perpendicular to said base member and a second forward configuration forwardly offset relative to said rearward configuration;

wherein:

said first side and said second side of said of said base member includes a plurality of forwardly graduated first sections and a plurality of forwardly graduated second sections, respectively, a corresponding pair of a respective first section and a respective second section defining a width that is greater than a width defined by a forwardly adjacent corresponding pair of a respective first section and a respective second section;

a respective first shelf assembly is pivotally coupled to each graduated first section; and a respective second shelf assembly is pivotally coupled to each graduated second section.

2. The shelving system as in claim 1, wherein:

each said first shelf assembly is spaced apart from and independently movable relative to each other first shelf assembly;

each said second shelf assembly is spaced apart from and independently movable relative to each other second shelf assembly.

3. The shelving system as in claim 2, wherein:

each first shelf assembly is pivotally connected to said first side of said base member and defines a longitudinal axis about which each said first shelf is selectively rotated between said first rearward configuration and said first forward configuration;

each second shelf assembly is pivotally connected to said second side of said base member and defines a longitudinal axis about which each said second shelf is selectively rotated between said second rearward configuration and said second forward configuration.

4. The shelving system as in claim 1, wherein:

each first shelf is pivotally connected to said first side of said base member and defines a longitudinal axis about which each said first shelf is selectively rotated between said first rearward configuration and said first forward configuration; and each second shelf is pivotally connected to said second side of said base member and defines a longitudinal axis about which each said second shelf is selectively rotated between said second rearward configuration and said second forward configuration.

5. The shelving system as in claim 3, wherein:

a respective first shelf assembly is parallel to said first side of said base member at said first forward configuration; and a respective second shelf assembly is parallel to said second side of said base member at said second forward configuration.

6. The shelving system as in claim 1, wherein:

each said first shelf assembly includes a plurality of vertically spaced apart shelves configured to support articles thereon;

each said second shelf assembly includes a plurality of vertically spaced apart shelves configured to support articles thereon;

each said first shelf assembly includes a first sheet of pegboard coupled to a rear portion thereof; and each said second shelf assembly includes a second sheet of pegboard coupled to a rear portion thereof.

7. The shelving system as in claim 1, comprising:

a first rear shelf assembly fixedly coupled to said first side of said base member that is generally perpendicular to said first side and extends away therefrom; and a second rear shelf assembly fixedly coupled to said second side of said base member that is generally perpendicular to said second side and extends away therefrom.

8. The shelving system as in claim 1, comprising:

a plurality of first rollers, at least one first roller being coupled to an underside of each first shelf assembly and configured to support a respective first shelf assembly on a floor surface and to enhance movement between said first rearward configuration and said first forward configuration; and a plurality of second rollers, at least one second roller being coupled to an underside of each second shelf assembly and configured to support a respective second shelf assembly on a floor surface and to enhance movement between said second rearward configuration and said second forward configuration.

9. The shelving system as in claim 1, wherein:

each first shelf assembly is pivotally coupled to said first side of said base member with a hinge; and each second shelf assembly is pivotally coupled to said second side of said base member with a hinge.

10. The shelving system as in claim 3, wherein:

each first shelf assembly is pivotally coupled to said first side of said base member with a hinge; and each second shelf assembly is pivotally coupled to said second side of said base member with a hinge.

11. The shelving system as in claim 10, wherein said hinge is a vertically floating hinge including:

a pin having a linear configuration;

a first leaf having at least a pair of spaced apart first-leaf knuckles rotatably coupled to said pin; and a second leaf having at least one second-leaf knuckle rotatably coupled to said pin, said second-leaf knuckle situated between said pair of spaced apart first-leaf knuckles and configured to slide along said pin between said pair of spaced apart first-leaf knuckles.

12. The shelving system as in claim 8, wherein:

each first shelf assembly is pivotally coupled to said first side of said base member with a vertically floating hinge;

each second shelf assembly is pivotally coupled to said second side of said base member with a vertically floating hinge;

wherein said vertically floating hinge includes:

a pin having a linear configuration;

a first leaf having at least a pair of spaced apart first-leaf knuckles rotatably coupled to said pin; and a second leaf having at least one second-leaf knuckle rotatably coupled to said pin, said second-leaf knuckle situated between said pair of spaced apart first-leaf knuckles and configured to slide along said pin between said pair of spaced apart first-leaf knuckles.

13. The shelving system as in claim 7, wherein:

each first shelf assembly is pivotally coupled to said first side of said base member with a vertically floating hinge;

each second shelf assembly is pivotally coupled to said second side of said base member with a vertically floating hinge;

wherein said vertically floating hinge includes:

a pin having a linear configuration;

a first leaf having at least a pair of spaced apart first-leaf knuckles rotatably coupled to said pin; and a second leaf having at least one second-leaf knuckle rotatably coupled to said pin, said second-leaf knuckle situated between said pair of spaced apart first-leaf knuckles and configured to slide along said pin between said pair of spaced apart first-leaf knuckles.

14. The shelving system as in claim 7, further comprising a plurality of ceiling support members coupled to said first rear shelf assembly and to said second rear shelf assembly and extending upwardly therefrom.

15. An adjustable shelving system, comprising:

an upstanding base member having a first side and a second side opposite said first side;

a plurality of first shelf assemblies pivotally coupled to said first side of said base member, each first shelf assembly being movable between a first rearward configuration generally perpendicular to said base member and a first forward configuration forwardly offset relative to said rearward configuration;

a plurality of second shelf assemblies pivotally coupled to said second side of said base member, each second shelf assembly being movable between a second rearward configuration generally perpendicular to said base member and a second forward configuration forwardly offset relative to said rearward configuration;

wherein said base member is a base shelving unit having a bottom shelf, an intermediate shelf upwardly displaced from said bottom shelf, and an upper shelf upwardly displaced from said intermediate shelf;

wherein said base shelving unit defines an open front, an open first side, and an open second side.

* * * * *